US005544609A

United States Patent [19]

Miller

[11] Patent Number: 5,544,609

[45] Date of Patent: Aug. 13, 1996

[54] EARLY PLANING BOAT HULL

[76] Inventor: James D. Miller, 28 Trail Rd., Bristol, Va. 24201

[21] Appl. No.: 492,718

[22] Filed: Jun. 20, 1995

[51] Int. Cl.[6] ..... B63B 1/32

[52] U.S. Cl. ..... 114/288

[58] Field of Search ..... 114/271, 274, 114/288, 292, 56, 57, 61, 291; D12/300, 309, 310, 311, 312, 313

[56] References Cited

U.S. PATENT DOCUMENTS

| | | | |
|---|---|---|---|
| 2,900,945 | 8/1959 | Canazzi | 114/288 |
| 3,051,115 | 8/1962 | Canazzi | 114/56 |
| 3,177,836 | 4/1965 | Salamin | 114/288 |
| 3,625,173 | 12/1971 | Mitton | 114/61 |
| 3,930,455 | 1/1976 | Bremer | 114/56 |
| 3,967,571 | 7/1976 | Mut | 114/61 |
| 3,996,869 | 12/1976 | Handley | 114/56 |
| 4,862,817 | 9/1989 | Hornsby et al. | 114/288 |
| 5,140,930 | 8/1992 | Lund | 114/291 |

*Primary Examiner*—Stephen Avila

[57] ABSTRACT

A boat hull configuration that generates lift upon forward movement in the water caused by two lateral side keels that run along either side of the hull, and a bottom surface that joins the two sides keels, wherein the forward portion of the bottom surface has a concave configuration which provides a pivot fulcrum surface, and wherein the forward portions of the keels have an inward slant from the front rearwardly to channel and trap water and air under the hull and result in the development of a force directed upward against the fulcrum surface to produce planing lift during powered forward motion of the boat.

17 Claims, 2 Drawing Sheets

EARLY PLANING BOAT HULL

BACKGROUND OF THE INVENTION

1. Field of the Invention

The present invention relates to boat hull design and configuration and particularly one which utilizes forward movement of the boat to direct and trap water and air under the hull, producing lift, which in turn minimizes the energy expenditures necessary to cause the hull to achieve and maintain a planing position.

2. Description of the Prior Art

The V-shaped hull is, of course, the most widely recognized design for water craft. However, this V shape has many characteristics that could be improved. For instance, it is widely known that the conventional "V" shaped hull design pushes water to the side, in a plow like manner, as the hull is pushed through the water. Thus, in terms of efficiency of energy utilization to move the boat through the water some of the total energy expended is wasted on pushing water to the side. Also, the V-shaped hull design is unstable and is easy to tip to the side which creates problems for passengers on entry and exit from the boat.

In this regard, a number of inventors have attempted to deal with such problems by developing hull designs that theoretically use less energy such as those of U.S. Pat. Nos. 3,625,173; 3,967,571; 3,996,869 and 5,140,930. A major problem also associated with such bi-hull or double keel design is that they still require considerable power to move them forward to a planing posture.

Objects, therefore, of the present invention are: to provide a boat hull which utilizes any type of thrust such as outboard, inboard, or jet power, and which will plane early using less power than is necessary to accomplish the same running position employing conventional "V" shaped or other hulls, including bi-hulls such as shown in the above patents; to provide a boat hull with greater directional stability than is found associated with respect to conventional "V" hull or bi-hull designs; to provide a hull with improved turn control, as well as rapid and controlled stops; to reduce, as compared to a conventional "V" shaped or bi-hull boat hull, the trailing wake left behind the moving hull; to provide a hull that provides a cushioned ride; to provide a hull having more expedient passenger access both on entry and on exit than is associated with a conventional "V" shaped boat hull; and to provide a hull that minimizes spray.

SUMMARY OF THE INVENTION

The above and other objects hereinafter becoming evident have been attained in accordance with the present invention which is defined in its broad sense as a boat hull configuration having floor means, a bow section, two sides generally longitudinally bordering said floor means, and a stern section, said floor means having a bottom surface, at least one upwardly formed cavity means in a forward portion of said bottom surface, wherein the lower portions of said sides are formed to provide two longitudinal, laterally spaced keels running along the sides of the hull with said bottom surface and cavity means extending therebetween, wherein a rearward surface portion of said cavity means provides a forwardly facing fulcrum means for engaging air and water as the hull is powered forward and causing upward pivoting of the rear of the boat in response to air and water pressure generated in the cavity means by forward motion of the boat.

In this regard, the present hull design acts to scoop and channel water under the hull within the cavity region and produces a pivot fulcrum force reaction which allows the motor to drive the rear of the hull-upwardly in a pivoting manner while providing hydraulic lift under other portion of the floor thereby reducing the force necessary to cause the hull to achieve and maintain a planing position.

In certain preferred embodiment:

(a) a substantial portion of the bottom of each keel is formed with a substantially planar water contact surface which is angled upwardly from the outboard side of the keel toward a longitudinal axis of the hull to provide a cutting edge on said outboard side of the keel for digging into the water in a turn and thereby minimizing or preventing chine-walk;

(b) said cavity means extends longitudinally from adjacent an anterior surface section of the bow to a longitudinal mid-area of the hull;

(c) each said water contact surface has a lateral dimension of from about 0.05 to about 0.2 of the average hull width, and has a longitudinal dimension of from about 0.3 to about 0.9 of the length of said hull;

(d) said cavity means is defined by an upwardly domed surface, and wherein the chord angle of a transition zone of said domed surface is from about 10 to about 15 degrees;

(e) said keels and the portion of said bottom surface lying aft of said cavity means providing pressure chute means for receiving and constricting a flow of air and water upon forward motion of said hull whereby upwardly directed force is effected against said bottom surface tending to levitate said hull; and (f) the inward side of a forward portion of each keel is slanted laterally inwardly from forward to aft for channeling water underneath the hull and into the area of said cavity means.

BRIEF DESCRIPTION OF THE DRAWINGS

The invention will be further understood from the following drawings and description of preferred embodiments of the invention wherein.

DETAILED DESCRIPTION OF THE DRAWINGS

Figure 1:
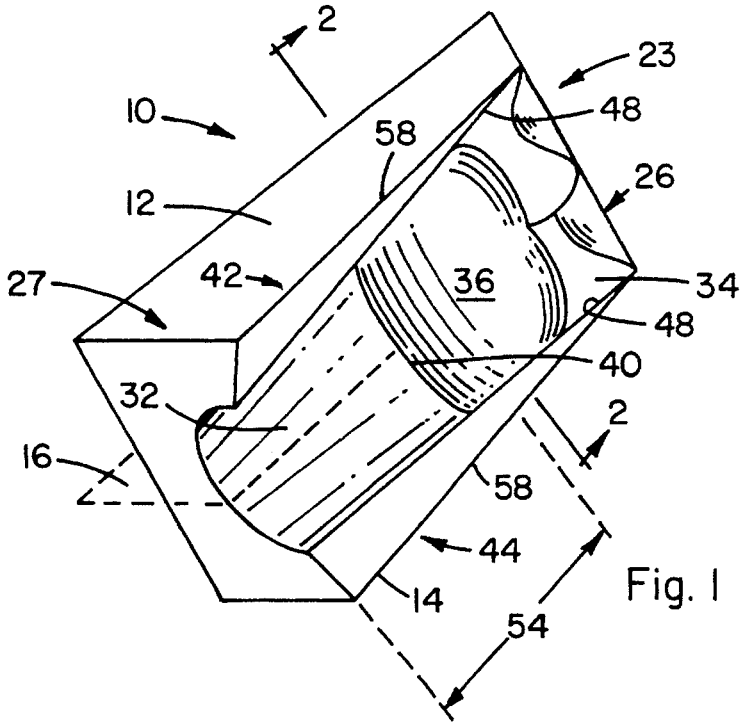
FIG. 1 is a perspective view of the hull bottom in one embodiment of the invention.
Figure 2:
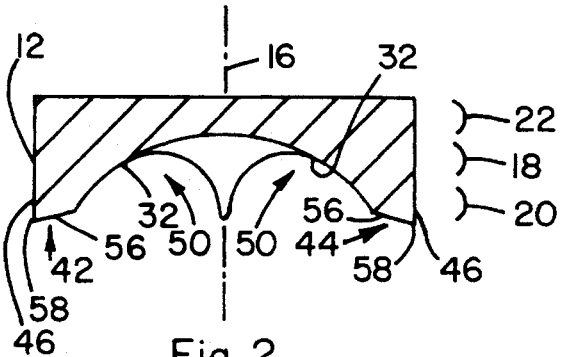
FIG. 2 is a cross-sectional view taken along line 2—2 of FIG. 1 in the direction of the arrows.
Figure 6:
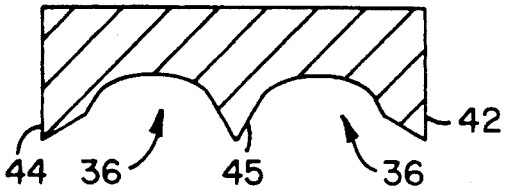
FIG. 6 is a lateral cross-sectional view as taken along line 2—2 of FIG. 1 but showing use of the present invention with a tri-keel hull and a cavity and fulcrum surface means on both sides of the center keel.

Referring to the drawings and with particular reference to the claims hereof, the present boat hull 10 is configured to produce an enhanced planing lift and comprises:

(a) two elongated sides 12, 14 lying on opposite sides of a longitudinal center plane 16 of the hull, each side, in a generally vertical direction, having an intermediate section 18, a performing lower section 20 and an upper gunnel section 22, the sides extending substantially the length of the hull;

(b) a bow region generally designated 23 having an upper gunnel section 24 and an anterior surface section generally designated 26;

(c) a stern region generally designated 27 having an upper gunnel section 28 and a lower section 30;

(d) a bottom surface generally designated 32 lying laterally between said intermediate sections of the two sides and running longitudinally of the hull from adjacent the bow region to the lower section of the stern region; and (e) the forward portion generally designated 34 of the bottom surface adjacent the bow region being configured to provide at least one upwardly directed cavity means 36 providing at least one air-water accumulation zone 38, the configuration providing fulcrum surface means 40 at the rear portion 41 of the cavity means about which the hull can pivot to a planing posture in response to forward motion of the boat and channeling of air and water into the cavity means and against the forward portion of the bottom surface in proximity to and forward of the fulcrum surface means.

The lower edge portion of each lower section 20 of the two sides provide two substantially parallel keels generally designated 42, 44 extending substantially the entire length of the hull, the outboard side surfaces 46 of each keel having a substantially vertical, planar shape, the inboard surface 48 of the forward portion of each keel being angled laterally inwardly toward said center plane to provide, in cooperation with the forward portion of the bottom surface, inlet means 50 to the cavity means, which cavity means is shaped to provide the air-water accumulation zone 38 of diminishing capacity from the inlet means 50 aft toward the rear 41 of the cavity means, the inboard surfaces of the forward portions of the keels being laterally inwardly slanted to capture water inboard of the keels and direct it against the forward portion of the bottom surface in proximity to the fulcrum surface to produce a reactive force against the bottom surface in reaction to the forward motion of the boat to thereby cause the aft section of said hull to pivot upwardly about the fulcrum means to a planing posture.

The cavity means 36 can have practically any lateral configuration such as generally circular, oblong, rectangular or the like as long as it provides an adequately sized fulcrum surface means 40 and an adequately sized accumulation zone 38. The size proportions as shown in the drawings represent a fully functional, exemplary design. The cavity means preferably extends longitudinally from adjacent the anterior surface section of the bow to a longitudinal mid-area generally designated 60 of said hull. The cavity means is defined by an upwardly domed surface, and wherein the transition zone chord angle is from about 8 to about 20 degrees, preferably from about 10 to about 15 degrees. The chord line extends from the fulcrum surface 40 to the crest 43 of the cavity and $\alpha$ is measured from the chord line to the plane 47 of the hull bottom surface 32. As shown in the drawings, the cavity, from fore to aft is preferably formed on a radius The sizes and shapes of the various structural portions of the hull, as well as the various designated "zones" and including, e.g., a third keel such as 45, may, of course, be varied by one skilled in the art to accommodate different overall hull dimensions and weights of the hull and engine, engine power and the like, in order to achieve the desired planing characteristics.

Preferably, a substantial portion of the bottom of each keel, e.g., section 54, is formed with a substantially planar water contact surface 56 which is angled upwardly from the water line from the outboard side of the keel toward the longitudinal axis 16 to provide a cutting edge 58 on said outboard side of each keel for digging into the water in a turn and thereby minimizing or preventing chine-walk or side-slip during the turn. Also, it is preferred that the water contact surface of each keel has a lateral dimension of from about 0.05 to about 0.2 of the average hull width, and has a longitudinal dimension of from about 0.3 to about 0.9 of the length of the hull.

Figure 7:
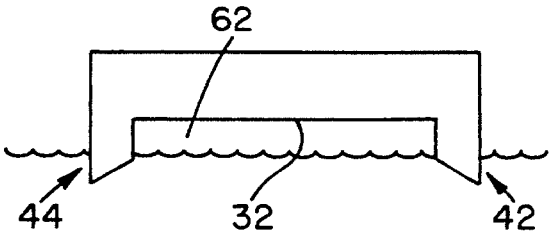
FIG. 7 is a rear view of the hull showing the pressure chute exit.
Figure 3:
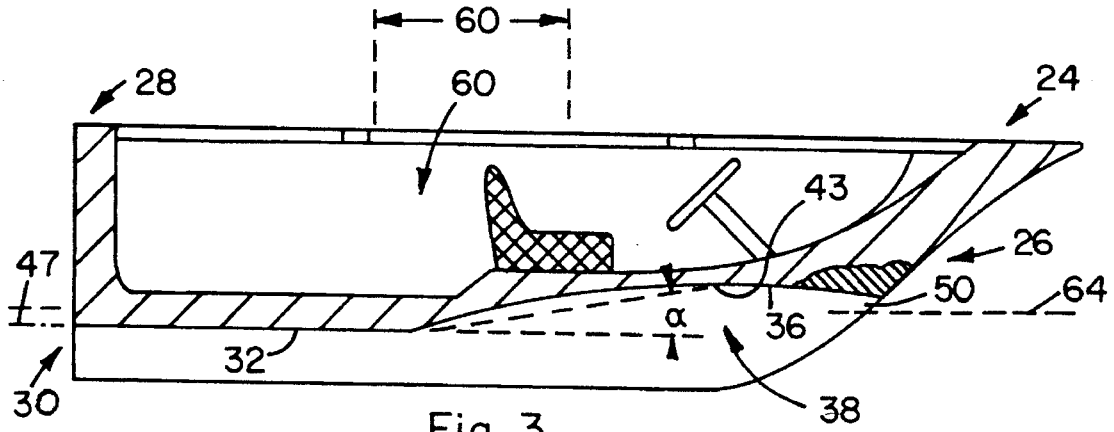
FIG. 3 is a longitudinal cross-section of the hull of FIGS. 1 and 2 taken through the center line but with the prow broken away for clarity, wherein the hull posture is substantially at rest in the water.
Figure 4:
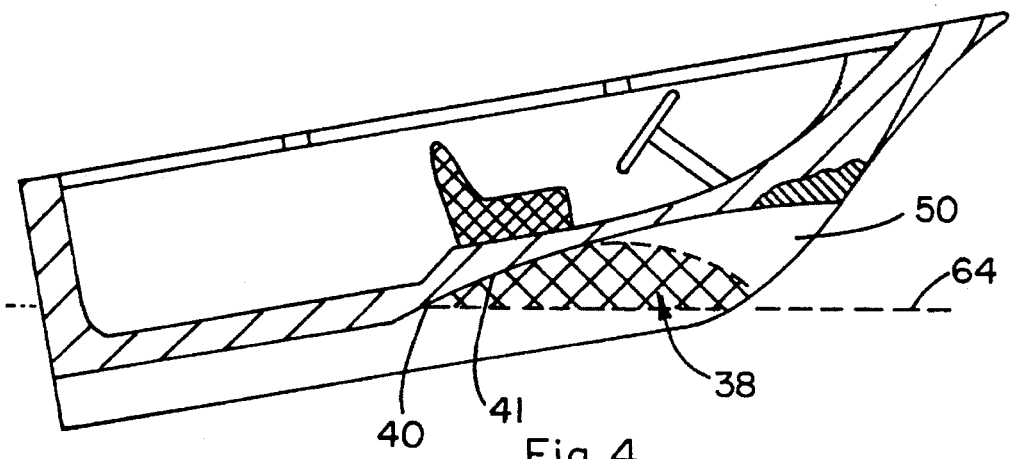
FIG. 4 is a view as in FIG. 3 but with the hull posture being substantially at maximum angle, i.e., during forward thrust just before planing.
Figure 5:
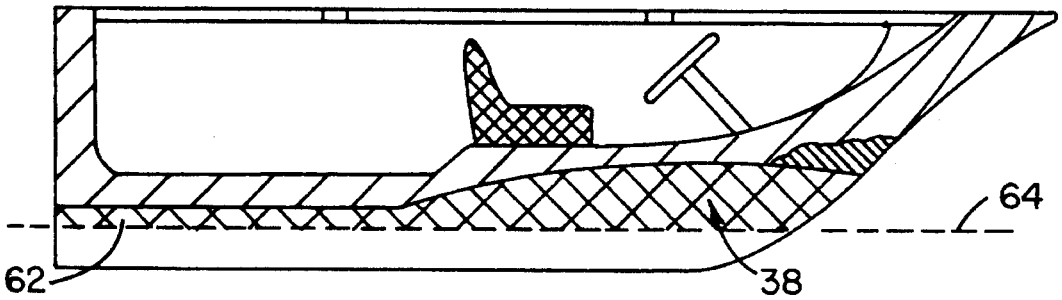
FIG. 5 is a view as in FIG. 3 but with the hull posture being substantially on plane.

Referring to FIGS. 5 and 7 wherein the hull posture is substantially at plane, the pressure chute means is generally designated 62 and is defined by the outboard keels 42, 44, the bottom surface 32, and the water surface 64. Upon forward planing motion of the boat, the air and water initially forced into the cavity means will now be forced through the chute means and generate sufficient pressure therein to readily force the aft portion of the hull upwardly and maintain a substantially even keeled, planing posture thereof. In the full planing posture of FIG. 5, mostly air will flow through zone 38 and chute 62, and the keels will provide the major flotation for the hull.

The invention has been described in detail with particular reference to preferred embodiments thereof, but it will be understood that variations and modifications will be effected with the spirit and scope of the invention.

I claim:

1. A boat hull configuration having floor means, a bow section, two outboard sides, and a stern section, said floor means having bottom surface means, at least one upwardly formed cavity means in a forward portion of said bottom surface means defined by an upwardly domed surface, at least two longitudinal, laterally spaced keel means running along the lower portions of the hull substantially the full length thereof with said bottom surface and cavity means extending therebetween, wherein a rearward surface portion of said cavity means is located adjacent the longitudinal mid-point of said bottom surface means and provides a forwardly facing fulcrum surface means extending generally upwardly for engaging air and water as the hull is powered forward and causing upward pivoting about said fulcrum surface means of the rear of the boat in response to air and water pressure generated in the cavity means by forward motion of the boat and directed against said fulcrum surface means.

2. The hull of claim 1 wherein said keel means comprises two outboard keels wherein a substantial portion of the bottom of each keel is formed with a substantially planar water contact surface which is angled upwardly from the outboard side of the keel toward a longitudinal axis of the hull to provide a cutting edge on said outboard side of the keel for digging into the water in a turn and thereby minimizing or preventing chine-walk.

3. The hull of claim 1 wherein said domed surface extends longitudinally in a substantially smooth and continuous manner from adjacent an anterior surface section of the bow to a longitudinal mid-area of the hull.

4. The hull of claim 2 wherein each said water contact surface has a lateral dimension of from about 0.05 to about 0.2 of the average hull width, and has a longitudinal dimension of from about 0.3 to about 0.9 of the length of said hull.

5. The hull of claim 1 wherein said cavity means is defined by an upwardly domed, substantially smooth surface, and wherein the chord angle of a transition zone of said domed surface is from about 10 to about 15 degrees.

6. The hull of claim 1 wherein said keels and the portion of said bottom surface lying aft of said cavity means provide pressure chute means for receiving and constricting a flow of air and water upon forward motion of said hull whereby upwardly directed force is effected against said bottom surface tending to levitate said hull.

7. The hull of claim 6 wherein the inward side of a forward portion of each keel is slanted laterally inwardly from forward to aft for channeling water underneath the hull and into the area of said cavity means.

8. A boat hull which is configured to produce an enhanced planing lift and comprising:

(a) two elongated sides lying on opposite sides of a longitudinal center plane of said hull, each said side, in a generally vertical direction, having an intermediate section, a performing lower section and an upper gunnel section, said sides extending substantially the length of said hull;

(b) a bow region having an upper gunnel section and an anterior surface section;

(c) a stern region having an upper section and a lower section;

(d) a bottom surface lying laterally between said intermediate sections of said two sides and running longitudinally of the hull from adjacent said bow region to the lower section of said stern region; and (e) the forward portion of said bottom surface adjacent said bow region being configured to provide an upwardly directed cavity means defined by an upwardly domes surface providing an air-water accumulation zone, the configuration providing fulcrum surface means at the rear of said cavity means which is located adjacent the longitudinal mid-point of said bottom surface and about which the hull can pivot to a planing posture in response to forward motion of the boat and channeling of air and water into said cavity means and against said fulcrum surface means.

9. The boat hull of claim 8 wherein the lower edge portion of each section of the two sides provide two substantially parallel keels extending substantially the entire length of the hull, the outboard side surfaces of each said keel having a substantially vertical, planar shape, the inboard surface of the forward portion of each said keel being angled laterally inwardly toward said center plane to provide, in cooperation with said forward portion of said bottom surface, inlet means to said cavity means, which cavity means is shaped to provide said air-water accumulation zone of diminishing capacity from said inlet means aft toward the rear of said cavity means, said inboard surfaces of said keels being adapted to capture water inboard of said keels and direct it against the forward portion of said bottom surface in proximity to said fulcrum surface means to produce a reactive force against said bottom surface in reaction to the forward motion of the boat to thereby cause the aft section of said hull to pivot upwardly about said fulcrum means to a planing posture.

10. The boat hull of claim 9 wherein a substantial portion of the bottom of each keel is formed with a substantially planar water contact surface which is angled upwardly from the outboard side of the keel toward said longitudinal axis to provide a cutting edge on said outboard side of the keel for digging into the water in a turn and thereby minimizing or preventing chine-walk.

11. The boat hull of claim 9 wherein said cavity means extends longitudinally from adjacent said anterior surface section to a longitudinal mid-area of said hull.

12. The boat hull of claim 10 wherein each said water contact surface has a lateral dimension of from about 0.05 to about 0.2 of the average hull width, and has a longitudinal dimension of from about 0.3 to about 0.9 of the length of said hull.

13. The boat hull of claim 9 wherein said cavity means is defined by an upwardly domed surface, and wherein the transition zone chord angle is from about 10 to about 15 degrees.

14. A planing boat hull that produces an enhanced planing lift comprising body means having:

(a) two generally perpendicular sides, each said side having a performing lower edge portion and an upper gunnel edge portion;

(b) a bow region having an upper gunnel edge portion and an anterior surface portion;

(c) a stern region having an upper edge portion and a lower edge portion; and (d) a sculptured bottom surface joining said lower edge portions of said two sides and running from adjacent the gunnel edge portion of the bow region to the lower edge portion of the stern region and formed at its forward portion to provide an upwardly domed cavity, the configuration of which provides fulcrum surface means located adjacent the longitudinal mid-point of said bottom surface and about which the hull can pivot to a planing posture in response to forward motion of the boat and channeling of air and water into said cavity means and against said fulcrum surface means;

the lower edge portion of the two sides and the sculptured bottom surface forming two substantially parallel keels running along substantially the entire length of the hull, the outboard surfaces of each said keel having a substantially vertical, planar shape, and the inboard surfaces of a leading end of each said keel slanting laterally inwardly toward the center line of the hull to provide, in cooperation with an adjacent, forward portion of said bottom surface, and air-water accumulation zone of diminishing capacity from its forward portion to its rearward portion, said inward slant of said inboard surfaces being adapted to capture water inboard of said keels to produce a reactive force against said bottom surface of said hull in reaction to the forward motion thereof to thereby cause further assist the aft section of said hull to pivot upwardly to a planing posture.

15. The hull according to claim 14 wherein said keels and the portion of said bottom surface lying aft of said cavity means, in cooperation with the water surface, provides pressure chute means for receiving and constricting a flow of air and water upon forward motion of said hull whereby upwardly directed force is effected against said bottom surface tending to levitate said hull.

16. A boat hull configuration having floor means, a bow section, two outboard sides, and a stern section, said floor means having bottom surface means, at least one upwardly formed cavity means in a forward portion of said bottom surface means, said cavity means being defined by an upwardly domed surface and wherein the chord angle of a transition zone of said domed surface is from about 10 to about 15 degrees, at least two longitudinal, laterally spaced keel means running along the lower portions of the hull with said bottom surface and cavity means extending therebetween, wherein a rearward surface portion of said cavity means provides a forwardly facing fulcrum surface means for engaging air and water as the hull is powered forward and causing upward pivoting of the rear of the boat in response to air and water pressure generated in the cavity means by forward motion of the boat.

17. A boat hull which is configured to produce an enhanced planing lift and comprising:

(a) two elongated sides lying on opposite sides of a longitudinal center plane of said hull, each said side in a generally vertical direction, having an intermediate section, a performing lower section and an upper gunnel section, said sides extending substantially the length of said hull, wherein the lower edge portion of each section of the two sides provides two substantially parallel keels extending substantially the entire length of the hull, the outboard side surfaces of each said keel having a substantially vertical, planar shape, the inboard surface of the forward portion of each said keel being angled laterally inwardly toward said center plane to provide, in cooperation with said forward portion of said bottom surface, inlet means to said cavity means, which cavity means is shaped to provide said air-water accumulation zone of diminishing capacity from said inlet means aft toward the rear of said cavity means, said inboard surfaces of said keels being adapted to capture water inboard of said keels and direct it against the forward portion of said bottom surface in proximity to said fulcrum surface means to produce a reactive force against said bottom surface in reaction to the forward motion of the boat to thereby cause the aft section of said hull to pivot upwardly about said fulcrum means to a planing posture;

(b) a bow region having an upper gunnel section and an anterior surface section;

(c) a stern region having an upper section and a lower section;

(d) a bottom surface lying laterally between said intermediate sections of said two sides and running longitudinally of the hull from adjacent said bow region to the lower section of said stern region; and (e) the forward portion of said bottom surface adjacent said bow region being configured to provide an upwardly directed cavity means providing an air-water accumulation zone, the configuration providing fulcrum surface means at the rear of said cavity means about which the hull can pivot to a planing posture in response to forward motion of the boat and channeling of air and water into said cavity means and against said fulcrum surface means, and wherein said cavity means is defined by an upwardly domed surface, and wherein the transition zone chord angle is from about 10 to about 15 degrees.

* * * * *